US006694106B2

(12) United States Patent
Yoshimura

(10) Patent No.: US 6,694,106 B2
(45) Date of Patent: Feb. 17, 2004

(54) IMAGE PROCESSING APPARATUS, A UNIT USED IN THE APPARATUS, AND A MEMORY DEVICE MOUNTED ON THE UNIT

(75) Inventor: Shotaro Yoshimura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/075,396

(22) Filed: Feb. 15, 2002

(65) Prior Publication Data

US 2002/0122671 A1 Sep. 5, 2002

(30) Foreign Application Priority Data

Feb. 19, 2001 (JP) ..... 2001-042424

(51) Int. Cl.[7] ..... G03G 15/00; G03G 21/16
(52) U.S. Cl. ..... 399/12; 399/111
(58) Field of Search ..... 399/12, 24, 25, 399/107, 109, 111; 347/108, 138, 152, 245, 263

(56) References Cited

U.S. PATENT DOCUMENTS 5,835,817 A * 11/1998 Bullock et al. ..... 399/25
5,926,665 A * 7/1999 Suzuki ..... 399/25
6,128,448 A * 10/2000 Arcaro et al. ..... 399/111 X
6,301,449 B1 * 10/2001 Miura ..... 399/12
6,351,618 B1 * 2/2002 Pollocks, Jr. ..... 399/12
6,351,621 B1 * 2/2002 Richards et al. ..... 399/111
6,366,742 B1 * 4/2002 Reihl et al. ..... 399/12

FOREIGN PATENT DOCUMENTS

JP 10-198236 7/1998

* cited by examiner

*Primary Examiner*—Sandra Brase
(74) *Attorney, Agent, or Firm*—Fitzpatrick, Cella, Harper & Scinto

(57) ABSTRACT

Information that has been stored in the memory of a unit removably provided in an image processing apparatus is managed effectively. To accomplish this, encrypted data and unencrypted data is stored, in distinguishable form, in a memory of a process cartridge removably attached to an electrophotographic printer.

20 Claims, 4 Drawing Sheets

IMAGE PROCESSING APPARATUS, A UNIT USED IN THE APPARATUS, AND A MEMORY DEVICE MOUNTED ON THE UNIT

FIELD OF THE INVENTION

This invention relates to a unit removably attached to an image processing apparatus such as a printer, an image processing apparatus to which the unit can be removably attached, a program and a recording medium for storing the program.

BACKGROUND OF THE INVENTION

Units that can be removably attached to an image processing apparatus such as a printer, scanner or copier are available in the prior art. Included among these units are units equipped with storage means (memory).

By way of example, in an electrophotographic printer that employs an electrophotographic image forming process, use is made of a process cartridge scheme in which an electrophotographic photosensitive body and process means for acting upon the electrophotographic photosensitive body, such as charging means, developing means and cleaning means, are integrated into the form of a cartridge serving as a removable unit. With the process cartridge scheme, the user himself can perform printer maintenance without relying upon a serviceman. The result is greatly enhanced convenience. The process cartridge scheme is presently being employed widely in electrophotographic printers.

It is well known that an electrophotographic printer of this kind is provided with a non-volatile memory that is capable of communicating with the interior of the process cartridge, as described in the specification of Japanese Patent Application Laid-Open No. 10-198236. An ID number, date of manufacture, name of manufacturer and recycle history (number of times recycled) are stored and retained in the non-volatile memory.

The printer is provided with a transceiver section for reading in information, which is necessary for an image forming operation, from the non-volatile memory. To start a printer operation, the above-mentioned information that has been stored in the non-volatile memory beforehand is read in via the transceiver section and the printer operates while each section of the printer is controlled using this information.

In order to improve service to users, more detailed management of customer information is now being requested. To meet such requests, the storing of user personal information in addition to the above-mentioned information is envisaged.

However, such user personal information is confidential information. If such information is stored in memory, there is the possibility that the information will be read and used.

SUMMARY OF THE INVENTION

Accordingly, an object of the present invention is to improve upon a unit removably attached to an image processing apparatus and having storage means, and to improve upon an image processing apparatus constructed so that the unit can be removably attached thereto.

Another object of the present invention is to provide a unit removably attached to an image processing apparatus and having storage means, wherein the unit is such that confidential information that has been stored in the storage means of the unit is protected with certainty, and an image processing apparatus constructed so that the unit can be removably attached thereto.

Another object of the present invention is to provide a unit removably attached to an image processing apparatus and having storage means, wherein the unit is such that confidential information that has been stored in the storage means of the unit is protected with certainty, and a recording medium storing a program for controlling an image processing apparatus constructed so that the unit can be removably attached thereto.

According to the present invention, the foregoing objects are attained by providing a unit removably attached to an image processing apparatus for performing a prescribed operation within the image processing apparatus, the unit including storage means having an encrypted data area and unencrypted data area.

According to another aspect of the present invention, the foregoing objects are attained by providing a unit removably attached to an image processing apparatus for performing an image forming operation within the image processing apparatus, the unit including storage means having an area for a storing encryption key and an area for storing data that has been encrypted by the encryption key.

According to the present invention, the foregoing objects are attained by providing an image processing apparatus, to which an image forming unit having storage means is removably attached, having control means for controlling read/write of data in the storage means, the control means reading/writing encrypted data and unencrypted data from/to the storage means.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

A preferred embodiment of the present invention will now be described in detail with reference to the drawings. However, unless specifically set forth in the specification, the relative placement of the components described in this embodiment does not impose a limitation upon the scope of the claims.

An electrophotographic printer having a removable process cartridge will be described as an embodiment of an image processing apparatus according to this invention. A non-volatile memory is mounted on this process cartridge.

The process cartridge is obtained by integrating, in cartridge form, an electrophotographic photosensitive body and at least one of charging means, developing means and cleaning means, and adapting this cartridge so that it can be removably attached to a printer.

Figure 1:
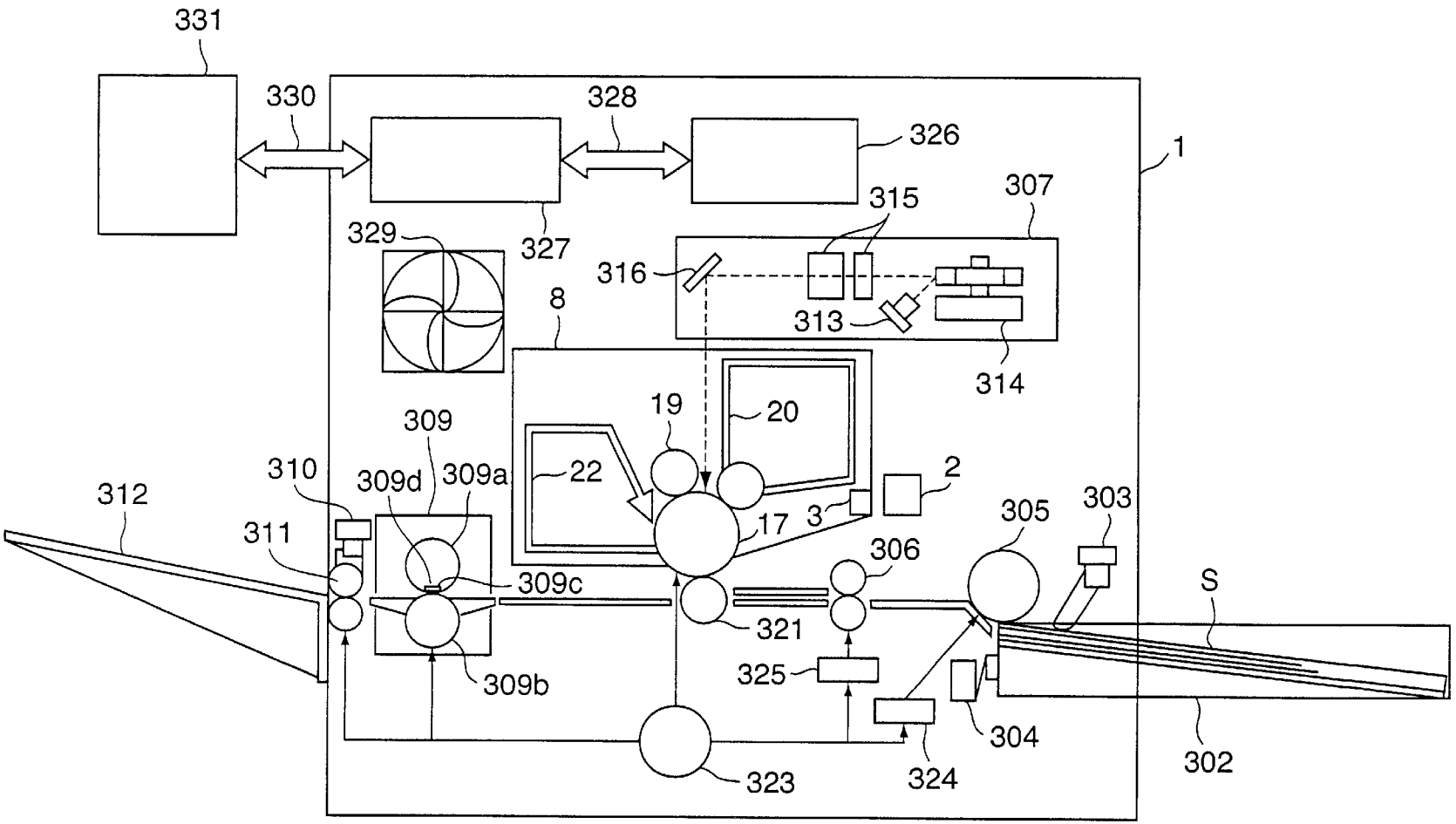
FIG. 1 is a diagram showing the general structure of a printer according to an embodiment of the present invention.

FIG. 1 is a diagram showing the general structure of an electrophotographic printer that employs an electrophotographic process according to the present invention. This illustrates a case where the printer is an laser printer.

A laser printer (hereinafter referred to simply as a printer) 1 has a cassette 302 for accommodating printing paper S and is provided with a cassette sensor 303 for sensing whether the printing paper S is present in the cassette 302, a cassette-size sensor (constituted by a plurality of microswitches) 304 for sensing the size of the printing paper S in the cassette 302, and a paper feed roller 305 for feeding the printing paper S from the cassette 302. A pair of registration rollers 306 for synchronously transporting the printing paper S are provided downstream of the paper feed roller 305.

A process cartridge 8 for forming a toner image on the printing paper S based upon laser light from a laser scanner 307 is provided downstream of the registration rollers 306. A fixing unit 309 for thermally fixing the toner image that has been formed on the printing paper S is provided downstream of the process cartridge 8. A paper discharge sensor 310 for sensing the state of paper transport at a paper discharge section, a paper discharge roller 311 for discharging the printing paper S and a stacking tray 312 for stacking the printing paper S on which printing has been completed are provided downstream of the process cartridge 8.

The laser scanner 307 is constituted by a laser unit 313 for emitting laser light that has been modulated by an image signal VDO, a polygon motor 314 for causing the laser light from the laser unit 313 is scan a photosensitive drum 17, an image forming lens 315 and a mirror 316.

The process cartridge 8 comprises the photosensitive drum 17, a primary charging roller 19, a developing unit 20, a transfer charging roller 321, a cleaner 22 and a non-volatile memory unit 3. The memory unit 3 is constituted by a non-volatile memory for storing and holding printing operation parameters, an ID number, the name of the manufacturer and recycle history (number of times recycled), etc., electrodes for communicating with the printer 1, and a controller for controlling these components.

The printer 1 incorporates a transceiver section 2 having communication electrodes and the like for sending and receiving data to and from the non-volatile memory (not shown) within the memory unit by communicating with the memory unit 3.

The electrodes of the memory unit 3 and transceiver section 2 are structured in such a manner that the electrodes contact each other under appropriate pressure when the cartridge is attached. Supply of power to the memory unit 3 from the printer side and exchange of data between the memory unit 3 and the printer take place through the electrode lines. The memory unit 3 is such that the printing operation parameters, the ID number, the name of the manufacturer and recycle history (number of times recycled), etc., have been stored in the internal non-volatile memory. This information is set individually for every process cartridge so as to obtain the optimum printing operation. In certain cases the information is updated depending upon the circumstances of use. When information is updated, data is sent to the memory unit 3 via the contact electrodes and is written to the non-volatile memory.

The fixing unit 309 is constituted by a fixing film 309*a*, a pressurizing roller 309*b*, a ceramic heater 309*c* provided within the fixing film, and a thermister 309*d* for detecting the surface temperature of the ceramic heater.

A main motor 323 applies a driving force to the paper feed roller 305 via a paper-feed roller clutch 324 and to the registration rollers 306 via a registration clutch 325. Further, driving power is applied to each component of the process cartridge 8 inclusive of the photosensitive drum 17 and to the fixing unit 309 and the paper discharge roller 311.

The engine controller 326 controls the electrophotographic process by controlling the laser scanner 307, the process cartridge 8 and the fixing unit 309, and controls the transport of the printing paper within the printer 1.

A video controller 327 is connected to an external device 331 such as a personal computer by a general-purpose interface (Centronics, RS232C, etc.) 330. Image information sent from the general-purpose interface is developed into bit data, which is then sent to the engine controller 326 as the VDO signal.

With regard to starting the printing operation, the engine controller 326, via the transceiver section 2, reads in various parameters necessary for printing stored in memory beforehand, and performs a printing operation while controlling various components in accordance with these parameters. A reference numeral 328 denotes an interface, which connects the engine controller 326 and the video controller 327.

The photosensitive drum 17 is rotated clockwise in FIG. 1 at a prescribed peripheral speed (process speed). In the process of being rotated, the photosensitive drum 17 is charged uniformly to a prescribed polarity and potential by the primary charging roller 19 serving as charging means. Meanwhile, the laser beam is modulated (controlled so as to turn on and off) in the laser scanner 307 in accordance with a time-series digital image signal representing image information of interest. The laser beam scans and exposes the uniformly charged surface of the photosensitive drum 17 so that an electrostatic latent image of the image information of interest is formed on the surface of the photosensitive drum 17. The electrostatic latent image that has been formed on the photosensitive drum 17 is developed and visualized by a developer (toner) in the developing unit 20 serving as developing means.

The printing paper S accommodated in the cassette 302 is fed out one sheet at a time by driving the paper feed roller 305. The sheets of printing paper S are supplied by the registration rollers 306 at a prescribed control timing to a transfer nip, which is the area of pressured contact between the photosensitive drum 17 and the transfer charging roller 321 serving as transfer means, and the toner images on the photosensitive drum 17 are transferred successively to the surface of the printing paper S. The sheets of printing paper S that have exited the transfer nip are separately successively from the surface of the photosensitive drum 17 during the rotation thereof, and the sheets of paper are introduced to the fixing unit 309 in order that the toner images may be fixed. Heat from the ceramic heater 309*c* is applied via the fixing film 309*a* to a sheet of printing paper S that passes between the fixing film 309*a* and the pressurizing roller 309*b*, and pressure is applied by the pressurizing roller 309*b* to thermally fix the toner image on the printing paper S. The printing paper S that has exited the fixing unit 309 is dropped into the stacking tray 312 by the paper discharge roller 311.

The photosensitive drum 17 from which the printing paper S has been separated is cleaned by removing attached contaminants, such as toner left from transfer, by the cleaner 22 serving as cleaning means. Thus the photosensitive drum 17 is repeatedly made ready for electrophotographic image formation that starts from the charging process.

Figure 2:
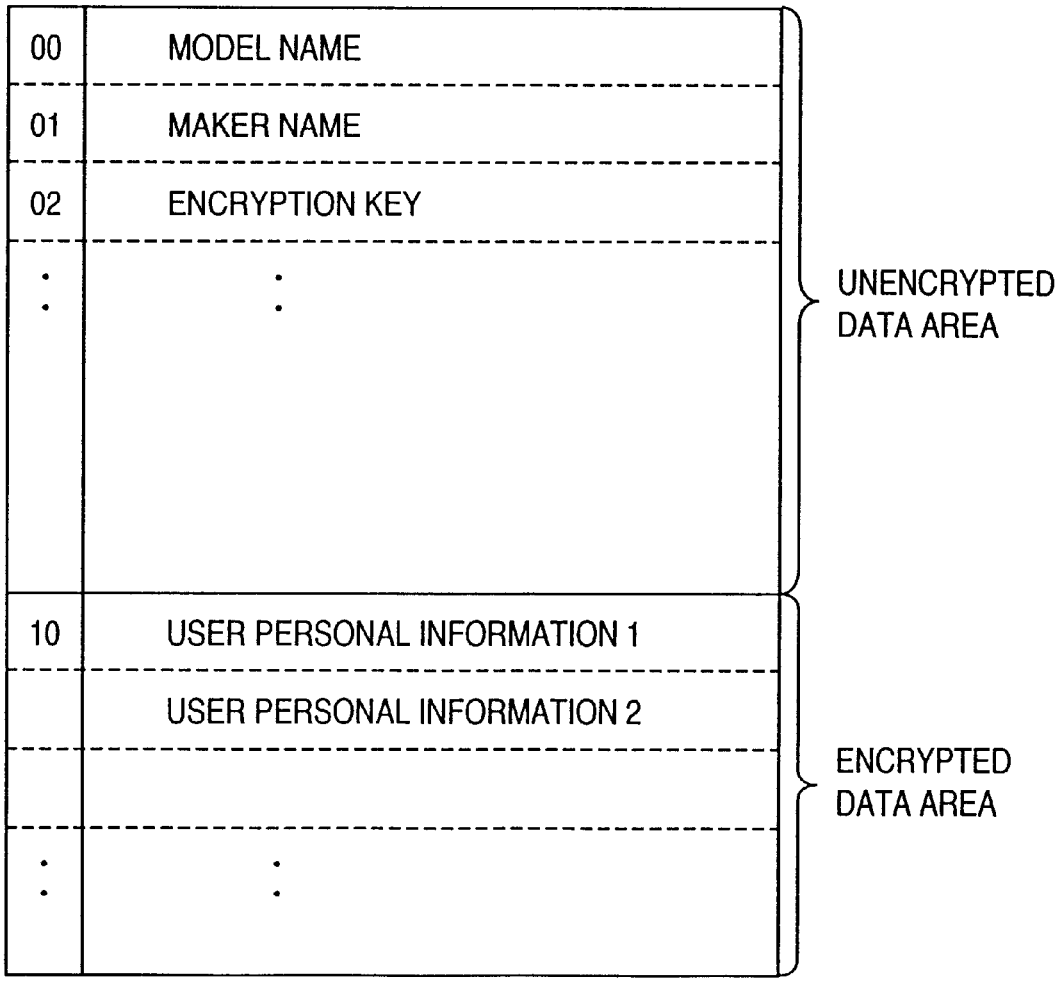
FIG. 2 illustrates a memory map within a non-volatile memory according to this embodiment of the present invention.

The non-volatile memory in the memory unit 3 has an area of encrypted data and an area of unencrypted data, as shown in FIG. 2. The write address of the memory is decided in accordance with the data content, and a controller performs encryption/decryption in accordance with the address.

The encrypted data stored in this memory is user personal information. In accordance with the stored user personal information, the manufacturer can utilize the information when resending a cartridge to the user, can disclose information that is beneficial to the user or can propose an optimum method of use that conforms to the way in which the printer is utilized by the user.

Information useful when performing management of the cartridge unit is included as unencrypted data. Examples of this information are printing operation parameters, ID number, the name of the manufacturer and the recycle history (number of times recycled), etc. On the basis of such information, the manufacturer readily accesses the non-volatile memory, acquires useful information relating to the cartridge unit and performs management. More specifically, on the basis of the information acquired, the manufacturer may suitably perform such operations and recycling of process cartridge parts and replenishment of toner.

Thus, there is no need to be concerned that confidential information, namely the user personal information, will be available to a third party. In addition, the manufacturer can utilize the user personal information to improve service to the user.

Encryption processing and decryption processing of the area of encrypted data may be executed using the data in the unencrypted data area of the non-volatile memory. In such case, the encrypted data will be decrypted in the transceiver section, etc., using the data in the unencrypted data area as the decryption key. Similarly, data for the purpose of being written to the encryption area is encrypted in the transceiver section, etc., using the data in the unencrypted data area as the key.

If data in the unencrypted data area is adopted as an encryption key or decryption key, it will no longer be necessary to set a decryption key anew for every process cartridge. This makes it possible to reduce the labor involved in setting keys. It should be noted that the data adopted as the encryption key or decryption key may be a single item of data or a plurality of items of data in the unencrypted data area.

Further, an encryption key may be stored in the unencrypted data area besides such data as the printing operation parameters, the ID number, the name of the manufacturer and the recycle history (number of times recycled), etc.

In this embodiment, a process cartridge on which a non-volatile memory has been mounted is described. However, this does not impose a limitation upon the present invention, for the invention is applicable to all units on which a memory is mounted. For example, the invention is applicable to the fixing unit and paper feed unit, etc., besides the process cartridge. It can be attached to all removable units regardless of whether they are replaceable by the user or by a serviceman. For example, there are instances where control of fixing in the fixing unit is changed depending upon the resistance value of a heater or by the manufacturer of a component used in the unit (because components made by different manufacturers usually are employed in the unit). Accordingly, if these items of information are stored in the memory of the fixing unit as parameters, fixing can be controlled more finely and the user can be provided with better image quality.

In this embodiment, the area of encrypted data and the area of unencrypted data are distinguished from each other by memory addresses. However, the areas may of course be distinguished from each other by hardware, such as by writing the data to separate chips. Further, the data may be provided individually with encryption identification flags or the like to distinguish the encrypted data from the unencrypted data.

In this embodiment, a process cartridge scheme is described as an example. This is a scheme in which an electrophotographic photosensitive body and devices such as charging means, developing means and cleaning means that operate upon the electrophotographic photosensitive body are integrated into the form of a cartridge serving as a removable unit. However, the removable unit is not limited to a process cartridge. A toner cartridge accommodating toner also is applicable.

In accordance with this embodiment, user personal information which is internal information in the non-volatile memory mounted in the process cartridge can be encrypted and stored and leakage of confidential information to a third party can be prevented. Furthermore, customer information can be managed in greater detail.

Processing for encrypted and decrypting data will now be described in detail with reference to FIG. 4.

Figure 4:
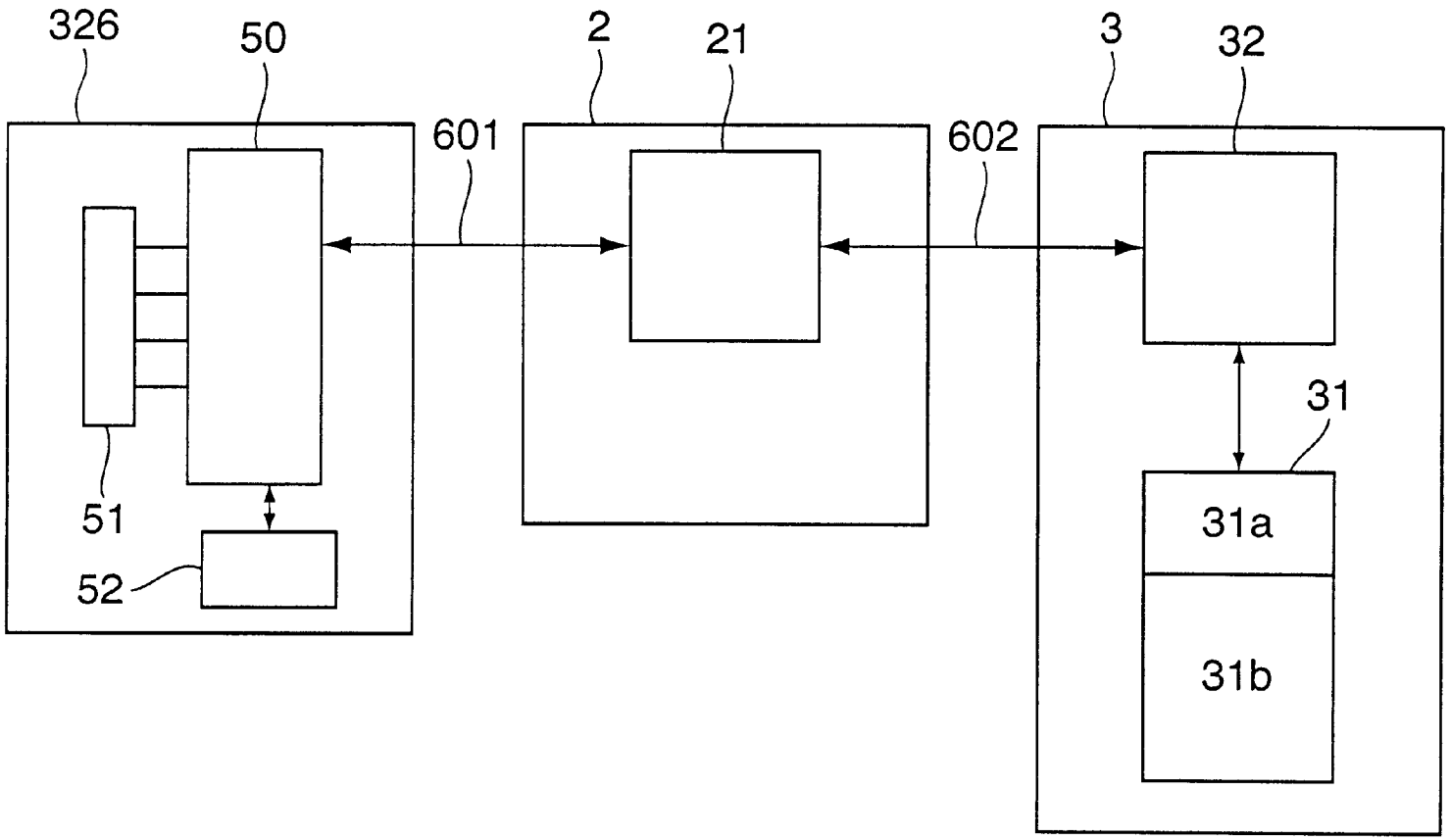
FIG. 4 is a block diagram illustrating control in this embodiment of the present invention.

FIG. 4 is a block diagram illustrating the control system in an image forming apparatus according to this embodiment.

As shown in FIG. 4, an engine controller 326 controls a main motor, a scanner motor, a paper-feed clutch, a registration clutch, a high-voltage unit and a heater drive circuit for a fixing unit, none of which are shown. Control is exercised so that the image forming apparatus 1 will form an image.

To achieve the above, the engine controller 326 mounts a CPU 50, which is constituted by a single-chip microcomputer, for example, and a drive circuit 51. The latter drives the motors and clutches (not shown) of the control system necessary to form an image.

The memory unit 3 mounted on the process cartridge 8 has a non-volatile memory 31, which includes an unencrypted data area 31*a* for storing unencrypted data and an encrypted data area 31*b* for storing encrypted data.

The transceiver section 2 has a communication circuit 21 for carrying out communication between the engine controller 326 and the memory unit 3. The communication circuit 21, which has a serial-signal interface (not shown) for interfacing the CPU 50, addresses the non-volatile memory 31 and designates read/write, thereby placing data to be stored and data that has been read out of the memory on a signal line 601 in a time series.

Furthermore, the communication circuit 21 converts the serial-data signal from the CPU 50 to a protocol suited communication and then transmits the signal. Further, data received from the memory unit 3 is converted to a serial-data signal suited to the CPU 50 and is then sent to the CPU 50.

The memory unit 3 has a transceiver circuit 32 for sending and receiving data between the non-volatile memory 31 and the transceiver section 2 and for controlling access to the non-volatile memory 31. A reference numeral 602 denotes a signal line, which connects the communication circuit 21 in the transceiver section and the transceiver circuit 32 in the memory unit 3.

The data encryption and decryption procedure will be described next.

Encryption and decryption processing is executed by the engine controller 326. First, in a case where user personal information or the like is written to the encrypted data area of the non-volatile memory 31, an encryption key that has been stored in ROM 52 of the engine controller 326 is read out and the data is encrypted in accordance with a prescribed encryption program using the encryption key. It should be noted that the ROM 52 may be provided in the transceiver section 2.

Further, in a case where an encryption key is not read out of the ROM 52 in the engine controller 326 but data that has been read out of the unencrypted data area is used as the encryption key instead, first the data in the unencrypted data area is read out. The data that has been read out is then used as the encryption key to encrypt data in accordance with the prescribed encryption program.

The encrypted data is written to the encrypted data area of the non-volatile memory 31 via the communication circuit 21 and transceiver circuit 32.

In a case where encrypted data in the encrypted data area is read out and decrypted, the encrypted data is read out of the non-volatile memory 31 via the communication circuit 21 and transceiver circuit 32, the encryption key used when encryption processing is executed is read out of the ROM 52 in the engine controller 326 or out of the unencrypted data area of the non-volatile memory 31, and the encrypted data is decrypted in accordance with the prescribed decryption program using the key as the decryption key. The decrypted data is transmitted to the CPU 50.

The encryption program and the decryption program have been stored in the ROM 52 in engine controller 326.

(Other Embodiments)

Figure 3:
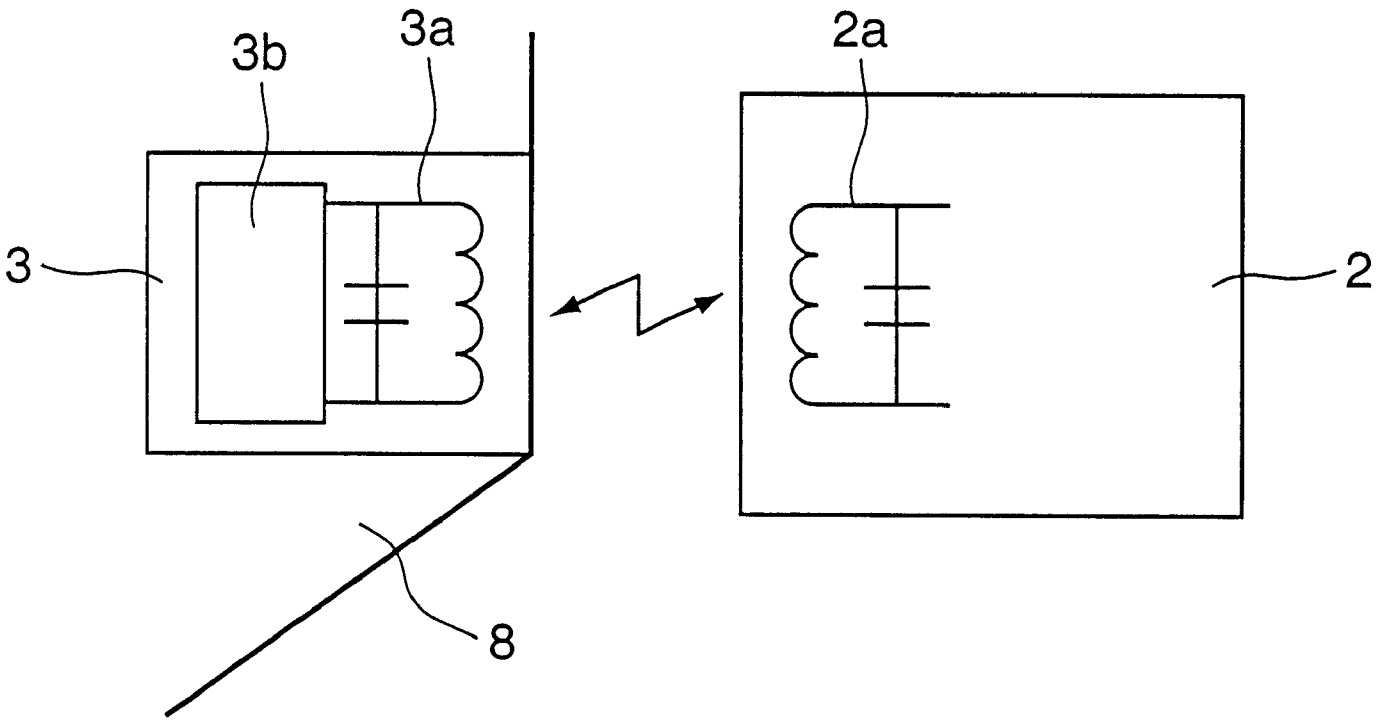
FIG. 3 is a diagram showing communication between a memory section and transceiver section according to another embodiment of the present invention.

As shown in FIG. 3, the memory and the transceiver section may communicate in contactless fashion. The contactless memory 3 includes a non-volatile memory for storing and holding various parameters necessary for printing, a contactless communication antenna 3*a* for communicating with the printer 1, and a controller 3*b* for controlling these components.

Furthermore, the printer 1 incorporates a contactless transceiver 2 having a contactless communication antenna 2*a* for sending and receiving data to and from a non-volatile memory communicating with the contactless memory.

Communication between the contactless memory and contactless transceiver section may be performed by amplitude modulation of carrier waves. If the contactless memory makes use of a power supply that is a voltage induced in a receiving antenna electromagnetically by the electromagnetic field of carrier waves emitted from the contactless transceiver section, an external power supply will not be necessary. At the same time, the controller within the contactless memory reads and writes the non-volatile memory in accordance with the amplitude-modulated signal emitted from the contactless transceiver section. Meanwhile, the contactless transceiver section reads the signal from the contactless memory based upon a change in impedance that appears in the transceiving antenna.

An electrophotographic printer is described in the above embodiment. However, the present invention is not limited to this arrangement and can be applied to all devices having a removable unit that performs a prescribed operation. For example, the invention is applicable to an electrophotographic copier, a laser printer, an LED printer, a facsimile machine, a word processor, a scanner and a digital video camera.

In order to realize the embodiment described above, suitable hardware is required but a major portion can be implemented by software. More specifically, the present invention is not limited solely to an apparatus and method for implementing the above-described embodiment. The invention covers also a case where a program for implementing the foregoing embodiment is supplied to a processor within the apparatus and the processor operates in accordance with the program, thereby implementing the embodiment. The program itself and the recording medium storing the program both fall within the scope of the present invention.

Examples of storage media are a floppy disk, a hard disk, an optical disk, a magneto-optical disk, a CD-ROM, magnetic tape, a non-volatile memory or an ROM, etc.

Furthermore, the scope of the present invention covers a program not only in a case where the embodiment is implemented by controlling various devices in accordance solely with the program supplied to the processor but also a program for a case where the above-described program cooperates with an operating system or the like running on the processor or with another program to implement the above embodiment.

In accordance with this embodiment, it is possible to provide a unit, an image processing apparatus, a program and a recording medium that make it possible to effectively manage information that has been stored in a memory of a unit removably provided in the image processing apparatus.

Furthermore, in accordance with the unit and image processing apparatus of the above embodiments, user personal information can be protected and customer information for providing services to a user can be managed in greater detail.

As many apparently widely different embodiments of the present invention can be made without departing from the spirit and scope thereof, it is to be understood that the invention is not limited to the specific embodiments thereof except as defined in the appended claims.

What is claimed is:

1. A unit removably attachable to an image processing apparatus for performing an image forming operation, said unit including:

a plurality of members, at least one of which is configured to perform the image forming operation, and storage means for storing data and having a first memory area configured to store information unique to said unit and a second memory area configured to store information that is encrypted based upon the information stored in said first memory area.

2. The unit according to claim 1, wherein said unit is at least one of a process cartridge, a toner cartridge, a fixing unit, and a paper-feed unit removably attached to the image processing apparatus, which forms an image by electrophotography.

3. The unit according to claim 2, wherein:

said plurality of members include an electrophotographic photosensitive body, charging means for charging said body, developing means for developing a latent image formed on said body, and cleaning means for cleaning said body; and said process cartridge is formed by integrating said electrophotographic photosensitive body and at least one of said charging means, said developing means, and said cleaning means.

4. The unit according to claim 2, wherein said plurality of members include a toner container configured to contain toner to be supplied to an electrophotographic photosensitive body and said toner cartridge has said toner container.

5. The unit according to claim 1, further comprising communication means for communicating data with communication control means provided in the image processing apparatus.

6. The unit according to claim 5, wherein said communication means communicates data with the communication control means provided in the image processing apparatus without contacting the communication control means.

7. The unit according to claim 1, wherein information relating to a user is stored in said second memory area.

8. An image processing apparatus, to which an image forming unit having storage means for storing data is removably attached, comprising:

a control device configured to control reading and/or writing of data in the storage means wherein:

the storage means has a first memory area configured to store information unique to the unit and a second memory area; and said control device controls the writing of data in the storage means so that information, which is encrypted based upon the information stored in the first memory area, is stored in the second memory area.

9. The apparatus according to claim 8, wherein said image processing apparatus is an apparatus which forms an image by electrophotography, and the unit is at least one of a process cartridge, a toner cartridge, a fixing unit, and a paper-feed unit.

10. The apparatus according to claim 8, wherein said control device has communication means for communicating data with the unit.

11. The apparatus according to claim 10, wherein said communication means performs data communication without contacting the unit.

12. The apparatus according to claim 8, wherein information relating to a user is stored in the second memory area.

13. The apparatus according to claim 8, wherein the information stored in the second memory area is decrypted by said control device using the information stored in the first memory area.

14. A memory device mounted on a unit removably attachable to an image processing apparatus for performing an image forming operation, the unit including a plurality of members, at least one of which is configured to perform the image forming operation, said memory device comprising:

a first memory area configured to store information unique to the unit; and a second memory area configured to store information encrypted based upon the information stored in said first memory area.

15. The memory device according to claim 14, wherein information stored in said second memory area includes information relating to a user.

16. The memory device according to claim 14, wherein the image processing apparatus is an apparatus that forms an image by electrophotography and the unit is either a process cartridge, a toner cartridge, a fixing unit or a paper-feed unit.

17. The memory device according to the claim 16, wherein:

the plurality of members include an electrophotographic photosensitive body, charging means for charging the body, developing means for developing a latent image formed on the body, and cleaning means for cleaning the body; and the process cartridge is formed by integrating the electrophotographic photosensitive body and at least one of the charging means, the developing means and the cleaning means.

18. The memory device according to claim 16, wherein the plurality of members include a toner container configured to contain toner to be supplied to an electrophotographic photosensitive body and the toner cartridge has said toner container.

19. The memory device according to claim 14, further comprising communication means for communicating data to communication control means mounted in the image processing apparatus.

20. The memory device according to claim 19, wherein said communication means performs non-contact data-communication.

* * * * *

UNITED STATES PATENT AND TRADEMARK OFFICE

CERTIFICATE OF CORRECTION

PATENT NO. : 6,694,106 B2
DATED : February 17, 2004
INVENTOR(S) : Shotaro Yoshimura It is certified that error appears in the above-identified patent and that said Letters Patent is hereby corrected as shown below:

Column 3,
Line 7, “an” should read -- a --.

Column 4,
Line 52, “separately” should read -- separated --.

Column 10,
Line 18, “the” should be deleted.

Signed and Sealed this

Twenty-second Day of June, 2004

JON W. DUDAS
*Acting Director of the United States Patent and Trademark Office*